US008406673B2

(12) United States Patent
Rimai

(10) Patent No.: US 8,406,673 B2
(45) Date of Patent: Mar. 26, 2013

(54) ROTATABLE MEMBER CLEANER FOR ELECTROPHOTOGRAPHIC PRINTER

(75) Inventor: Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 209 days.

(21) Appl. No.: 12/965,254

(22) Filed: Dec. 10, 2010

(65) Prior Publication Data

US 2012/0148285 A1 Jun. 14, 2012

(51) Int. Cl.
*G03G 21/00* (2006.01)
*G03G 15/09* (2006.01)

(52) U.S. Cl. ..... 399/345; 399/350; 399/274

(58) Field of Classification Search ..... 399/71, 399/345, 123, 350, 274
See application file for complete search history.

(56) References Cited

U.S. PATENT DOCUMENTS 3,927,640 A 12/1975 Smith et al.
3,981,272 A 9/1976 Smith
4,417,365 A * 11/1983 Murasaki ..... 15/256.51
4,571,071 A 2/1986 Bothner
5,438,398 A 8/1995 Tanigawa et al.
5,585,893 A * 12/1996 Fujita et al. ..... 399/159
6,608,641 B1 8/2003 Alexandrovich et al.
7,120,379 B2 10/2006 Eck
7,151,902 B2 12/2006 Rakov et al.
7,502,581 B2 3/2009 Jacobs et al.
7,599,634 B2 10/2009 Kuo et al.
2002/0168200 A1 11/2002 Stelter et al.
2006/0133870 A1 6/2006 Ng et al.
2008/0159786 A1 7/2008 Tombs et al.
2010/0053293 A1* 3/2010 Thayer et al. ..... 347/103

FOREIGN PATENT DOCUMENTS

JP 06161329 A * 6/1994
JP 2005331686 A * 12/2005
JP 2005352390 A * 12/2005

OTHER PUBLICATIONS

Machine translations of the above Japanese references.*

* cited by examiner

*Primary Examiner* — David Gray
*Assistant Examiner* — Sevan A Aydin
(74) *Attorney, Agent, or Firm* — Christopher J. White

(57) ABSTRACT

In an electrophotographic (EP) printer, a rotatable member includes a deposition area and a non-deposition area. A toner supply supplies toner to the member, and a moving receiving member receives from the deposition area of the rotatable member while the rotatable member rotates. The rotatable member is cleaned with a selectively-retractable blade in mechanical contact with the member so that toner is removed from the deposition area while the rotatable member rotates. An artifact sensor automatically detects a toner image artifact on the receiver. A controller responsive to the artifact sensor causes the blade to retract when an artifact is detected, and a blade cleaner cleans the blade while the blade is not in mechanical contact with the member.

7 Claims, 6 Drawing Sheets

ROTATABLE MEMBER CLEANER FOR ELECTROPHOTOGRAPHIC PRINTER

Reference is made to commonly-assigned, co-pending U.S. Publication No. 2012/0148284 (U.S. Ser. No. 12/965,230, filed Dec. 10, 2010), entitled "CLEANING ROTATABLE MEMBER IN ELECTROPHOTOGRAPHIC PRINTER" by Donald S. Rimai, U.S. patent application Ser. No. 12/915,126, filed Oct. 29, 2010, entitled CONTROLLING ELECTROPHOTOGRAPHIC DEVELOPER ENTERING TONING ZONE, by Donald S. Rimai, et al., and U.S. patent application Ser. No. 12/947,894, filed Nov. 17, 2010, entitled REMOVING ELECTROPHOTOGRAPHIC CARRIER PARTICLES FROM PHOTORECEPTOR, by Donald S. Rimai, the disclosure of which are all incorporated herein.

FIELD OF THE INVENTION

This invention pertains to the field of electrophotographic printing and more particularly to cleaning toner off members in an electrophotographic printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Toner is required to be cleaned off members in EP printers for various reasons, including cleaning and maintenance. For example, residual or non-transferred toner is preferably cleaned off members of the printer so that it is not transferred to the receiver. When a receiver jams (paper jam), toner that would have been deposited on that receiver in normal operation is cleaned off members of the printer so that it does not contaminate components such as the transfer backup roller. Also, some printers deposit test patches used to monitor printer status; those patches are not intended for deposition on a receiver, so they are cleaned off the members on which they are deposited. However, toner can build up on cleaning members, resulting in image artifacts. For example, clumps of toner can build up behind a cleaning blade and break off when large enough; these clumps can travel through the printer and contaminate the member that was being cleaned or other members.

It is known to remove developer from a development member used to develop the latent image into the visible image. This can be useful for maintenance of a printer. U.S. Pat. No. 3,927,640 to Smith describes a magnetic gate for stopping developer flow when it is desired to purge the development system. U.S. Pat. No. 3,981,272 to Smith et al. describes a development system with a movable sump for storing developer. However, both of these schemes provide only off or on control, not variations in developer flow.

Commonly-assigned U.S. Pat. No. 7,502,581 to Jacobs et al., the disclosure of which is incorporated herein by reference, describes a movable metering blade for a magnetic brush development station to reduce build-up of contamination. However, this invention, although useful, also provides only two positions of the metering blade.

There is, therefore, a continuing need for a way of cleaning a rotatable member (e.g., a belt or drum) in an electrophotographic (EP) printer and reducing the occurrence of image artifacts resulting from cleaning.

SUMMARY OF THE INVENTION

According to the present invention, there is provided apparatus for cleaning a rotatable member in an electrophotographic (EP) printer, comprising:

a. the rotatable member having a deposition area and a non-deposition area; a toner supply operatively connected to the rotatable member to supply toner to the rotatable member, and a moving receiving member arranged with respect to the rotatable member so that toner is transferred from the deposition area of the rotatable member to the receiving member while the rotatable member rotates;

b. a selectively-retractable blade in mechanical contact with the member so that toner is removed from the deposition area while the rotatable member rotates;

c. an artifact sensor for automatically detecting a toner image artifact on the receiver;

d. a controller responsive to the artifact sensor for causing the blade to retract when an artifact is detected; and e. a blade cleaner for cleaning the blade while the blade is not in mechanical contact with the member.

An advantage of this invention is that it provides effective cleaning of rotatable members and minimizes the effects of image artifacts. Toner artifacts (e.g., streaks) can be detected and corrected without causing additional artifacts (e.g., clumps). Various embodiments advantageously selectively remove toner agglomerates when there is a risk of image defects due to those agglomerates. Various embodiments advantageously remove other contaminants that can cause defects or damage the photoreceptor, such as carbon fibers from composite printer components, carrier particles, and fibers from receivers.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
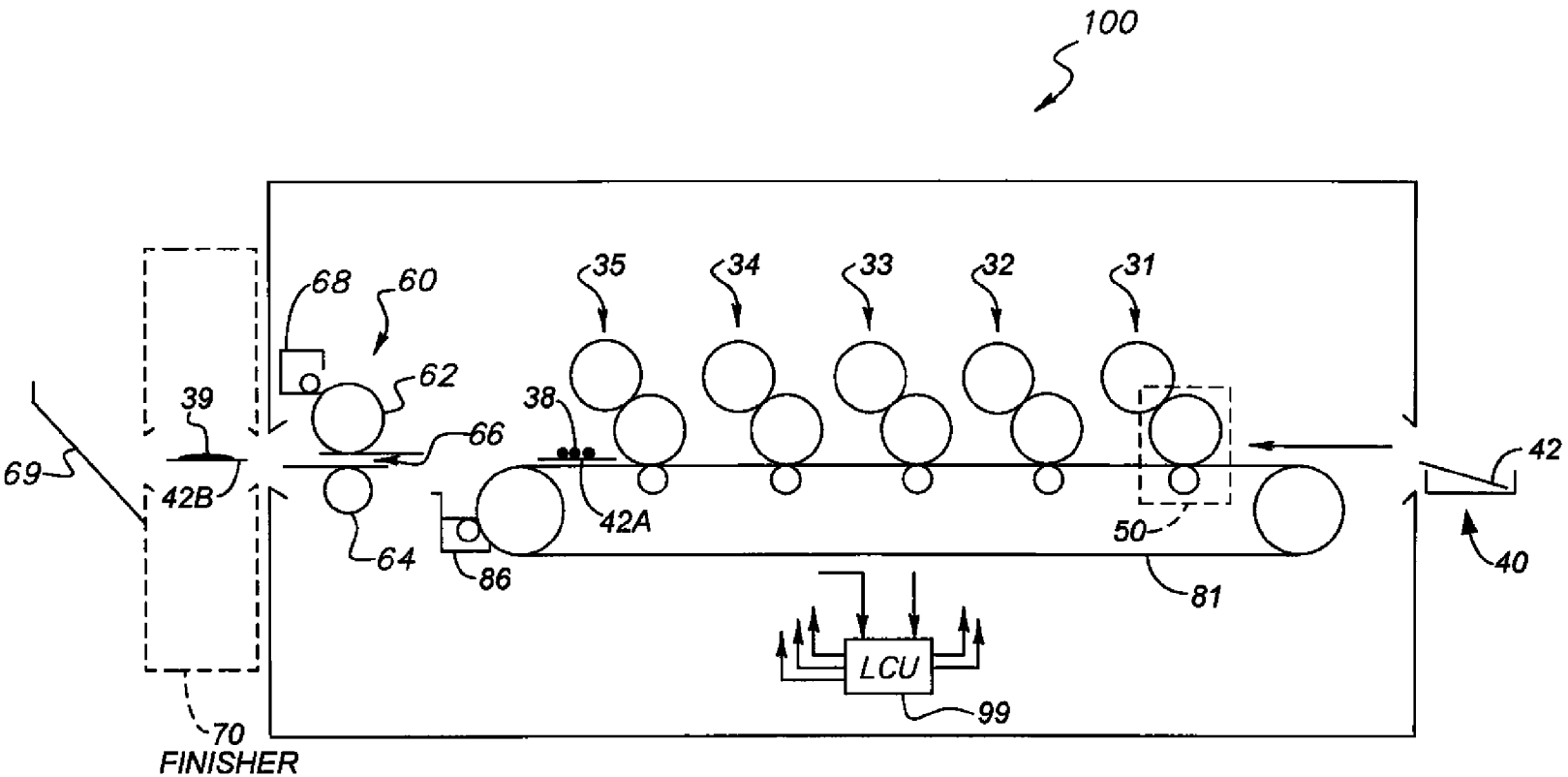
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

In an embodiment of an electrophotographic modular printing machine useful with the present invention, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
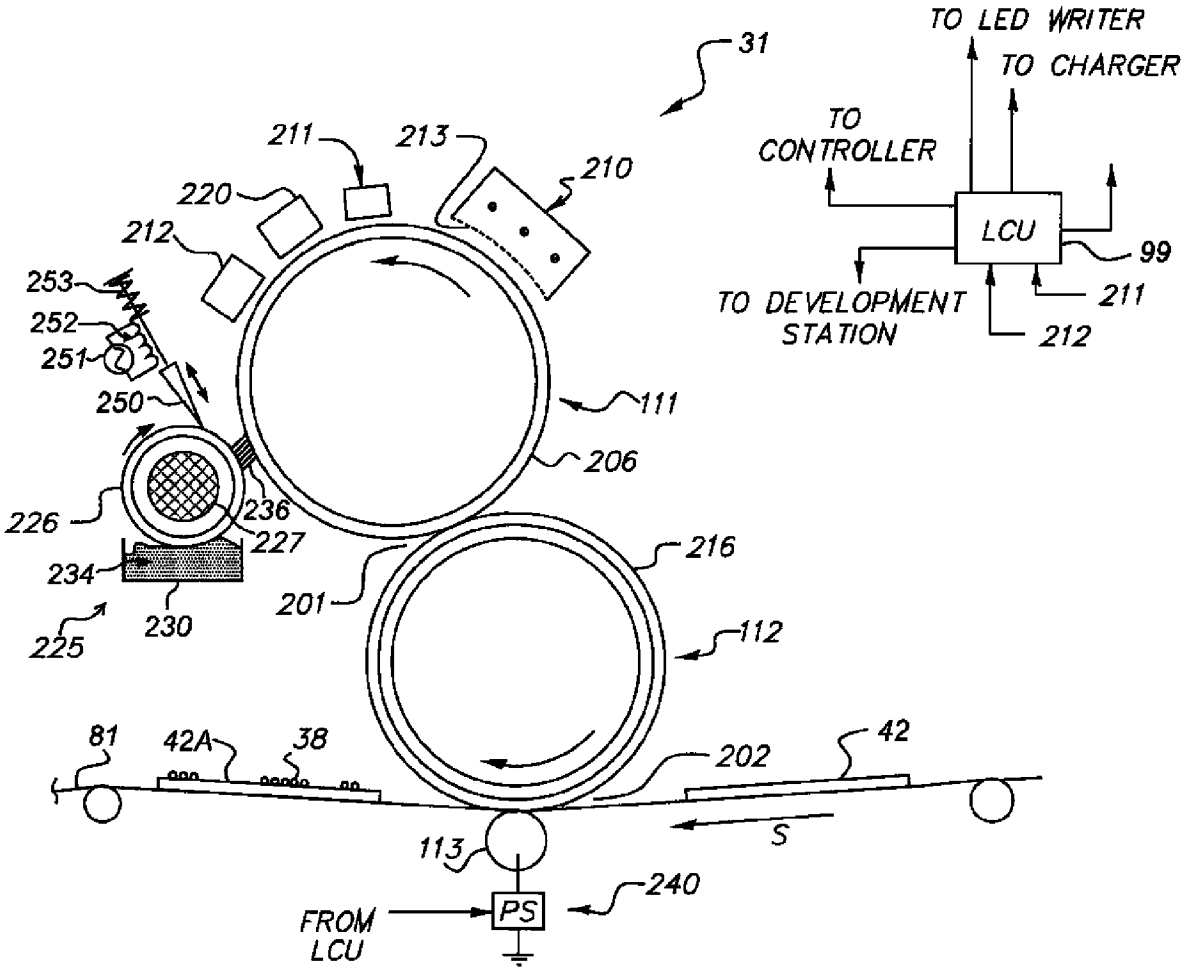
FIGS. 2-3 are an elevational cross-sections of one printing module of the apparatus of FIG. 1 according to various embodiments.
Figure 3:
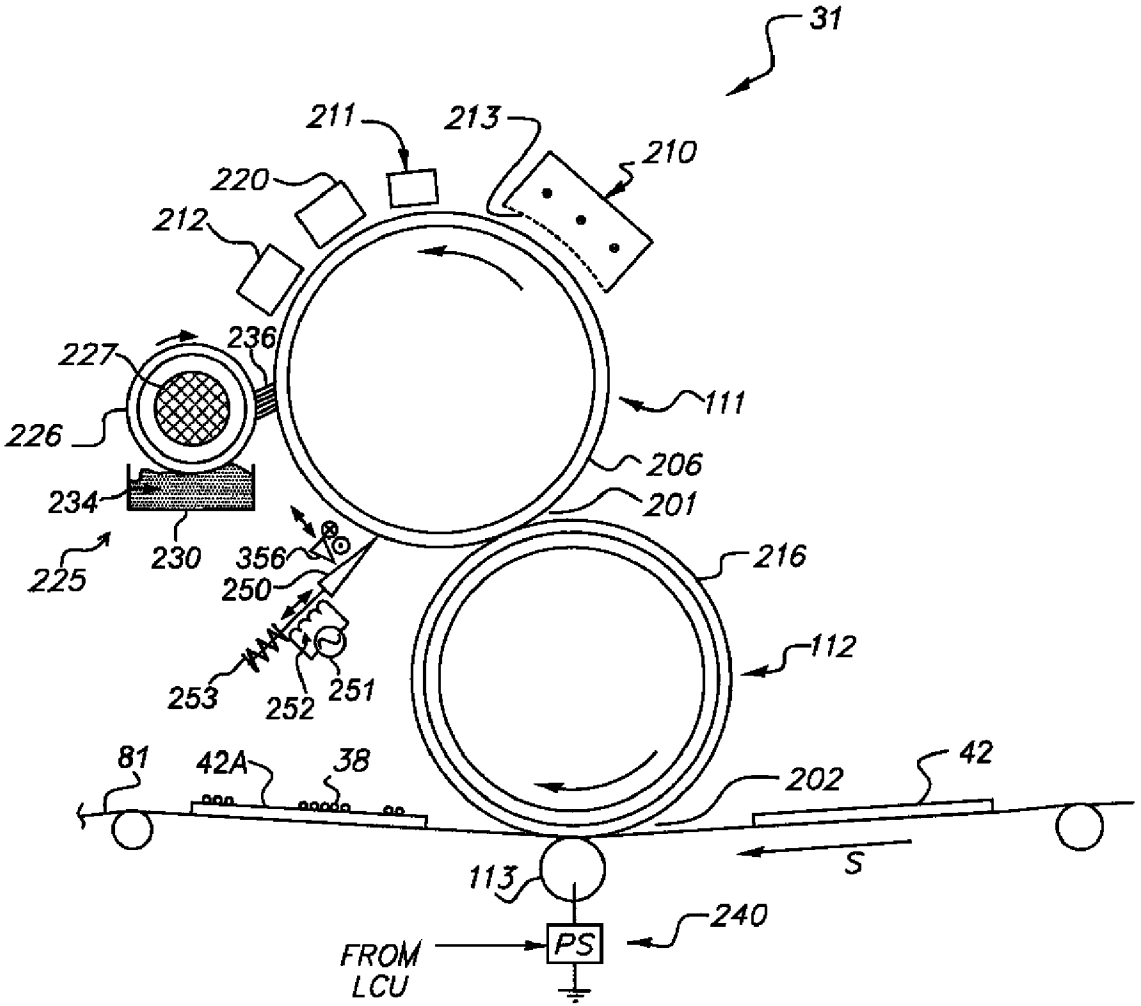

FIGS. 1-3 are elevational cross-sections showing portions of a typical electrophotographic printer 100 suitable for use with various embodiments. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003 to Peter S. Alexandrovich et al., U.S. Publication No. 2006/0133870, published on Jun. 22, 2006 by Yee S. Ng et al., U.S. Publication No. 2008/0159786, published on Jul. 3, 2008 by Thomas N. Tombs et al., U.S. Pat. No. 7,151,902, issued on Dec. 19, 2006 to David M. Rakov et al., and U.S. Pat. No. 7,599,634, issued on Oct. 6, 2009 to Chung-Hui Kuo et al., the disclosures of which are incorporated herein by reference.

FIG. 2 shows more details of an example of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

As used herein, the term "development member" refers to the member(s) or subsystem(s) that provide toner to photoreceptor 206. In an embodiment, toning shell 226 is a development member. In another embodiment, toning shell 226 and magnetic core 227 together compose a development member.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., 42B) which receives the respective toned print images 38 from each printing module in superposition to form a composite image thereon. Print image 38 is e.g., a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Still referring to FIG. 2, toner is transferred from toning shell 226 to photoreceptor 206 in toning zone 236. As described above, toner is selectively supplied to the photoreceptor by toning shell 226. Toning shell 226 receives developer 234 from developer supply 230, which can include a mixer. Developer 234 includes toner particles and carrier particles.

Blade 250 is arranged in proximity with the surface of toning shell 226 (or another development member) to clean the development member, or to control the amount of developer entering toning zone 236. Blade 250 can be moved closer to or farther from the surface of the development member using electromagnetic actuator 252 (represented graphically in FIG. 2 as a coil). Electromagnetic actuator 252 can be a solenoid, motor (servo or stepper), electromagnetically-operated linkage, or other electrical or electromechanical device for converting electrical current to mechanical motion of blade 250. Non-electromagnetic (e.g., pneumatic or hydraulic) actuators can also be used. In an embodiment, current is supplied by power source 251 (shown in FIG. 2 as an AC voltage supply).

In an embodiment, spring 253 produces a force on blade 250 opposite the force provided by electromagnetic actuator 252. In another embodiment, electromagnetic actuator 252 drives blade 250 in both directions.

FIG. 3 shows another embodiment of printing module 31. Print image 38, receivers 42A, 42B, transport web 81, image member 111, transfer member 112, transfer backup member 113, transfer nips 201, 202, photoreceptor 206, charging subsystem 210, meters 211, 212, grid 213, surface 216, exposure subsystem 220, development subsystem 225, toning shell 226, magnetic core 227, developer supply 230, developer 234, toning zone 236, power sources 240, 251, actuator 252, and spring 253 are as shown in FIG. 2.

Blade 250 is arranged in proximity with the surface of photoreceptor 206 to clean toner off photoreceptor 206. Blade 250 can be moved closer to or farther from the surface of photoreceptor 206, e.g., using electromagnetic actuator 252.

In various embodiments, the toner particles cleaned off photoreceptor 206 are removed by wiping blade-cleaning member 356 across the surface of the blade while it retracts. Blade-cleaning member 356 can be movable or fixed in position. A fixed blade-cleaning member 356 can be set at an angle to the blade, so that as disengaged blade 250 retracts past blade-cleaning member 356, toner (or whatever combination of carrier particles, toner particles, and contaminants is present on the blade) is pushed to or off the end of blade 250. A movable blade-cleaning member 356 can be pushed across disengaged blade 250 while blade 250 retracts, or after blade 250 retracts.

Figure 4:
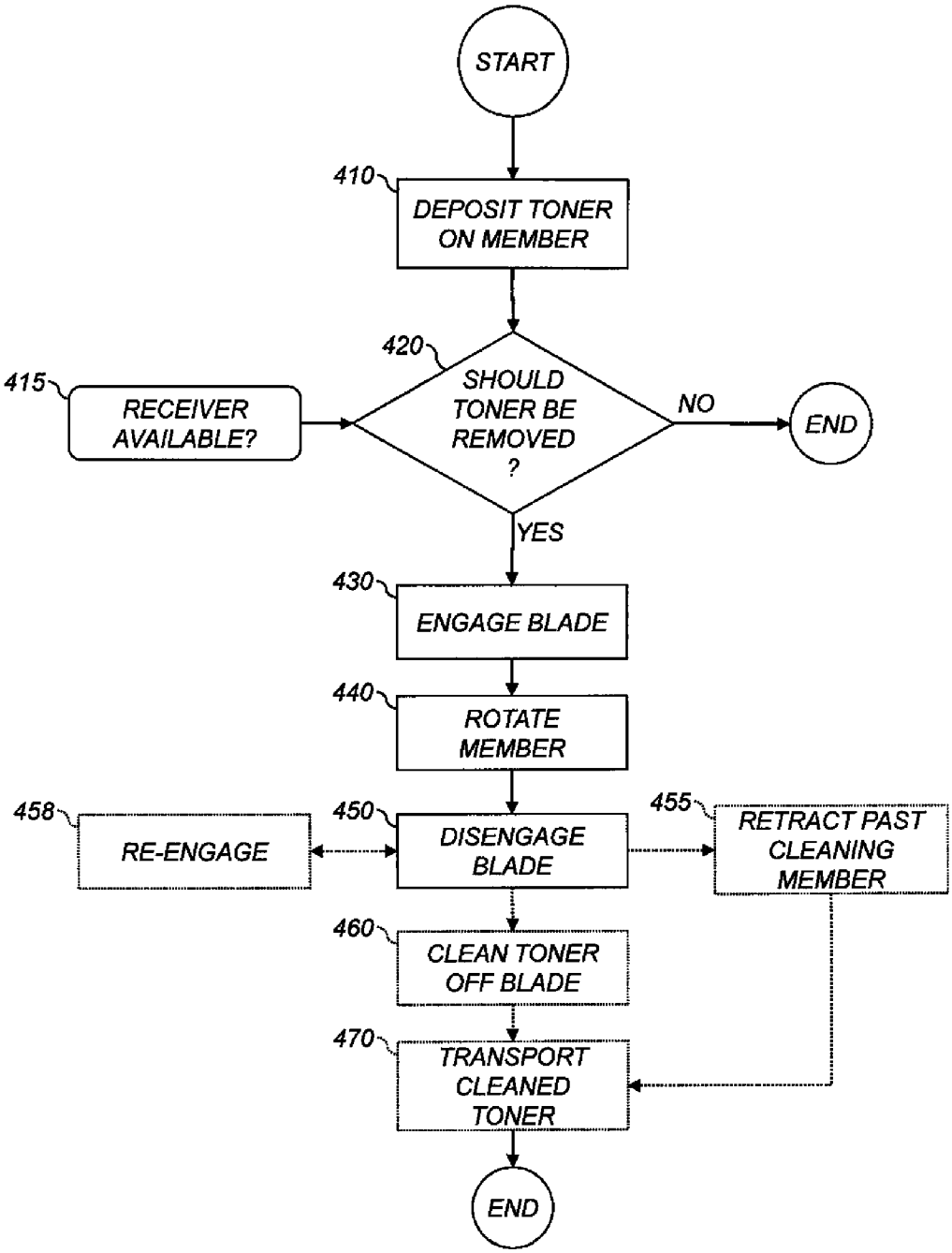
FIG. 4 is a flowchart of a method of cleaning a rotatable member useful with various embodiments.

FIG. 4 is a flowchart of a method of cleaning a rotatable member in an electrophotographic (EP) printer, e.g., a dry EP printer, useful with various embodiments. Processing begins with step 410.

In step 410, toner (solid or liquid) is deposited in a selected area on the member. For example, toner can be developed onto a photoreceptor to form a visible image, or transferred from a photoreceptor to a transfer member. Step 410 is followed by decision step 420.

In decision step 420, a processor (e.g., LCU 99, FIG. 1) is used to automatically decide whether some or all of the deposited toner should be removed from the member. If toner should be removed, the next step is step 430. If not, the method is done.

In embodiments, e.g., in which the member is a photoreceptor or transfer member, the processor determines whether toner should be removed from the selected area based on receiver available data 415 indicating whether a receiver is available to receive the deposited toner from the member. For example, paper jams can cause a receiver not to be available to receive the visible image to form the print image, so the toner which would otherwise have been transferred to the receiver should be removed from the member to reduce the probability of contamination with toner of the inside of the printer.

In step 430, reached if toner should be removed, a blade is engaged with the member so that the blade is in mechanical contact with the member. The blade can engage directly with area from which toner should be removed, or engage outside that area and sweep the area as the member rotates. Step 430 is followed by step 440.

In step 440, the member is rotated so that toner is removed from the selected area of the member by the blade. Step 440 is followed by step 450.

In step 450, after the selected area passes the engaged blade, the blade is disengaged. Step 450 is optionally followed by steps 458, 455, or 460, In optional step 458, the blade is re-engaged with the rotatable member, preferably in the non-deposition area of the same frame or a subsequent frame (skip frame), as will be discussed further below. Step 458 is followed by step 450.

In optional step 460, toner is cleaned off the disengaged blade. Cleaning can be performed while the blade retracts, or after it is fully retracted. Other material cleaned off the member by the blade, e.g., carrier particles, paper fibers, or contaminants, can also be cleaned off the blade. Step 460 is followed by step 470.

In optional step 455, the cleaning is accomplished by retracting the disengaged blade past a blade-cleaning member, so that toner on the blade is cleaned off. Step 455 is followed by step 470.

In step 470, the toner cleaned off the blade is transported away from the member. The toner can be transported to a waste-toner bottle. Other material cleaned off the member by the blade can also be transported.

In various embodiments, the member is selected from the group consisting of a photoreceptor (drum or belt), an intermediate transfer belt, an intermediate transfer cylinder or blanket cylinder, and a transport web, e.g., for transporting a receiver through the printer.

In an embodiment, the member is a transport member, and toner is deposited directly on the transport member, and cleaned off the transport member by the blade. For example, the toner can be deposited to form test patches or fiducials useful for monitoring registration or calibration of the printer as it prints, and that toner can be removed only when appropriate.

In an embodiment, the blade is useful for scraping off overspray from a photoreceptor or transfer member when producing a borderless print. When printing out to the edges of the receiver, some toner can be deposited off the receiver onto the member holding it because of misregistration, machine tolerances, or electrostatic repulsion. The toner off the receiver is referred to herein as "overspray." In this embodiment, the member is a transport member (web or drum) with a receiver disposed over the surface of the transport member. Depositing toner step 410 includes printing a print image on an image side of the receiver while the transport member rotates. The selected area is not under the receiver, e.g., surrounds the receiver, is adjacent to the receiver on one or more (adjacent or separated) sides, or is spaced apart from the receiver. In this embodiment, any toner present in the selected area is overspray, and the processor determines (in decision step 420) that the overspray should be removed from the selected area.

Figure 5A:
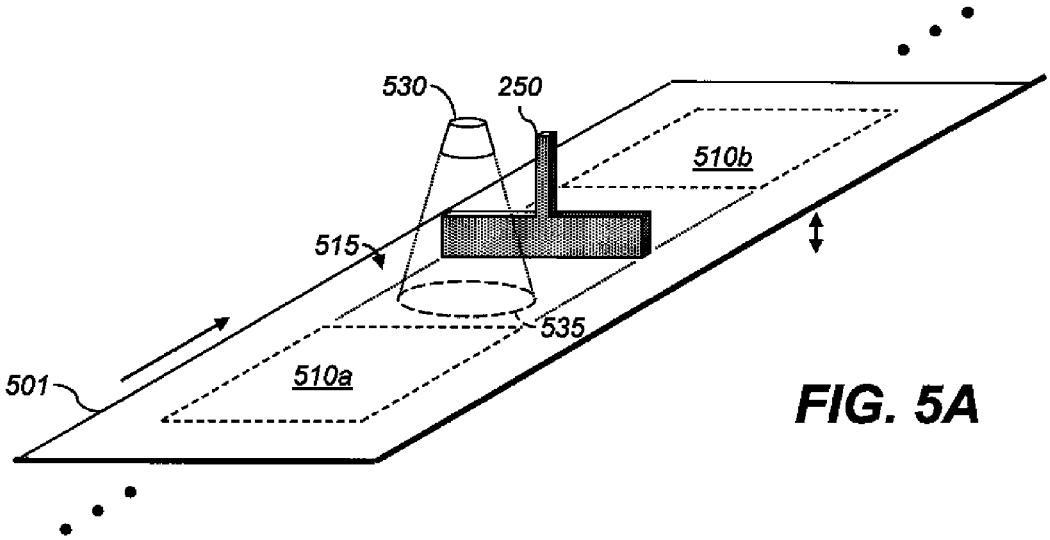
FIG. 5A shows a perspective of apparatus for cleaning a rotatable member in an electrophotographic (EP) printer useful with various embodiments.

FIG. 5A shows a perspective of an apparatus for cleaning a rotatable member in a dry electrophotographic (EP) printer according to various embodiments. In this embodiment, rotatable member 501 is shown as a section of a web or belt; a drum can also be used. The dotted lines are only for clarity and do not depict features. Rotatable member 501 has toner deposition areas 510*a*, 510*b* in which toner can be deposited on to the member and non-deposition area 515. For example, if rotatable member 501 is a transport belt, the interframe area where test patches go is the deposition area and frame area, over which the receiver is placed, is the non-deposition area.

Selectively-retractable blade 250 is in mechanical contact at least one point with rotatable member 501 so that toner is removed from the deposition area (e.g., 510*a*, 510*b*) while rotatable member 501 rotates. That is, blade 250 scrapes or pushes at least some of the toner in a deposition area (e.g., 510*a*) off rotatable member 501 (or some of the carrier particles, contaminants, or other substances on the surface of rotatable member 501). Blade 250 can be set at an angle to the direction of motion of the surface of rotatable member 501 so that scraped-off toner is directed towards a side or end of rotatable member 501.

In various embodiments, blade sensor 530 is used as described below for detecting when blade 250 is in mechanical contact with non-deposition area 515. Blade sensor 530 can include a camera and light source (not shown), or an electrometer for sensing toner on rotatable member 501. In an embodiment, blade sensor 530 measures inspection area 535 on the surface of rotatable member 501. Blade sensor 530 can also measure the positions of registration marks on rotatable member 501 or be responsive to an encoder connected to rotatable member 501. Blade sensor 530 can include a timer for determining when blade 250 enters or leaves inspection area 535. Blade 250 can be located in inspection area 535.

Figure 5B:
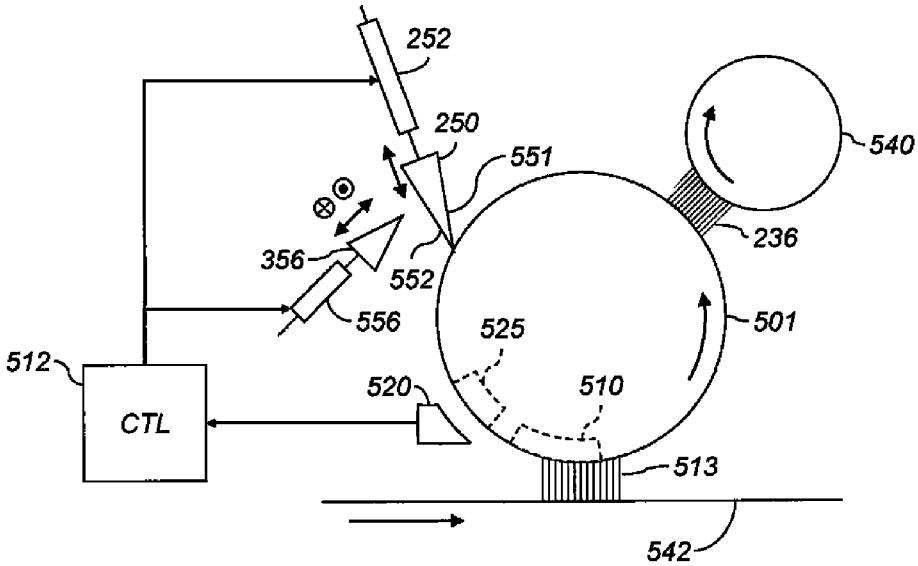
FIG. 5B shows a side elevational cross-section of apparatus for cleaning a rotatable member in an electrophotographic (EP) printer according to various embodiments.

FIG. 5B shows a side elevational cross-section of apparatus for cleaning a rotatable member in a dry electrophotographic (EP) printer according to various embodiments. Toner supply 540 is operatively connected to rotatable member 501 to supply toner to rotatable member 501 in toning zone 236. Moving receiving member 542 (which can move rotationally or linearly) is arranged with respect to rotatable member 501 so that toner is transferred from toner deposition area 510 of rotatable member 501 to receiving member 542 while rotatable member 501 rotates. These embodiments advantageously remove contaminants deposited on member 501 during toning in toning zone 236, or between toning and transfer in transfer zone 513. Specifically, rotatable member 501 further includes transfer zone 513 arranged after the deposition area (toning zone 236) in the direction of rotation of member 501, and blade 250 is arranged with respect to rotatable member 501 after the deposition area (toning zone 236) and prior to transfer zone 513 in the direction of rotation of member 501.

Artifact sensor 520 automatically detects a toner image artifact on the receiver. For example, as blade 250 removes toner, toner can build up on the leading edge of blade 250 or become jammed between blade 250 and the surface of rotatable member 501. This can lead to streaks of toner being smeared on the surface of rotatable member 501. Such streaks are, or result in, highly-objectionable artifacts in a print image. In an embodiment, artifact sensor 520 includes a camera and light source (not shown) looking at inspection area 525 on the surface of rotatable member 501. The image captured by the camera is transformed by a 2-D Fourier transform (e.g., FFT) to find features having much greater amplitude in one direction than its perpendicular. These features are classified as streaks. Toner agglomerates, dust, carrier particles, carbon fibers included in composite components of the printer for strength, and other particulate debris can also deposit or build up on or around blade 250. These types of debris can become attached to the receiver, resulting in a print with objectionable tactile roughness (bumps). They can also pass into the toning zone and have toner deposited on them, then flake off, leaving objectionable unprinted dots (voids) on the print image.

Figure 7:
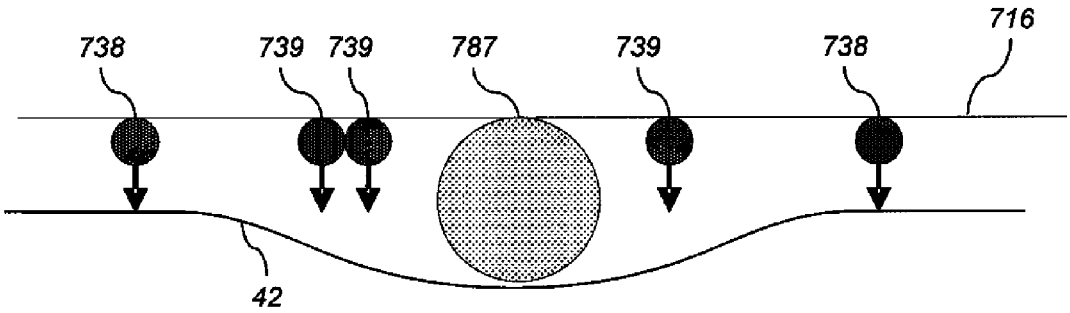
FIG. 7 shows an example of a defect that can result from particulate contamination.

FIG. 7 shows an example of another defect that can result from particulate contamination. Contaminant 787 is lodged between surface 716, e.g., surface 216 (FIG. 2) of intermediate transfer member 112 (FIG. 2), and receiver 42. This defect can also occur when transferring toner between the surfaces of two members in the printer. The normal spacing between receiver 42 and surface 716 is selected or controlled so that toner particles 738 can transfer from surface 716 to receiver 42. However, contaminant 787 acts as a stand-off or tent pole, and holds receiver 42 farther away from surface 716 than desired. Therefore, toner particles 739 are energetically unable to transfer from surface 716 to receiver 42, resulting in a halo of un-toned area around contaminant 787.

Referring back to FIG. 5B, when the number or area of streaks, bumps, voids, or other defects, exceeds a selected threshold, or the length, mean density, or peak density of a given defect exceeds a selected threshold, it is determined that the defects are unacceptable. Artifact sensor 520 can also include an electrometer, densitometer, photocell, CCD, or magnetic sensor for detecting defects. For example, a magnetic sensor can be used to detect magnetic carrier particles that have become contaminants.

Controller 512 is responsive to artifact sensor 520 for causing blade 250 to retract away from the surface of rotating member 501 when an artifact is detected. Controller 512 can be a CPU, FPGA, PLD, microcontroller, or other digital or analog control system. Controller 512 sends a command to actuator 252 to cause it to move blade 250.

A blade cleaner, e.g., blade-cleaning member 356, cleans blade 250 while blade 250 is not in mechanical contact with rotatable member 501. Blade-cleaning member 356 can clean after blade 250 is fully retracted or can start cleaning as soon as blade 250 is no longer in mechanical contact with the surface of rotatable member 501.

In various embodiments, blade-cleaning member 356 is stationary. That is, blade-cleaning member 356 is not intended to move. It can vibrate or translate due to thermal changes in the machine. Blade-cleaning member 356 is arranged with respect to blade 250 to clean blade 250 while the blade retracts. In one example, blade-cleaning member 356 is a squeegee set at a 45° angle to the direction of travel of blade 250 so that as blade 250 retracts, toner is swept along its length (into or out of the page in FIG. 5B) from one end to the other. Toner and other material cleaned off the blade can be transported to a waste container.

In various embodiments, blade-cleaning member 356 is movable. Actuator 556 (e.g., an electromagnetic or pneumatic actuator) is responsive to controller 512 to push movable blade-cleaning member 356 across retracted blade 250.

In various embodiments, engaged blade 250 makes mechanical contact with the member at contact surface 551 of blade 250. In the example shown in FIG. 5B, contact surface 551 makes an acute angle with the tangent to rotatable member 501 at the point of contact. Toner particles which are small enough or strongly-enough adhered to the surface of rotatable member 501, can slip between blade 250 and rotatable member 501 and adhere to non-contact surface 552 (the back side) of blade 250. Toner (or other material) is therefore cleaned off contact surface 551 and non-contact surface 552 of blade 250 in these embodiments. Two blade-cleaning devices can be used, or blade 250 can be rotated 180° of roll or pitch with respect to the axis of blade 250 in and out of the page in this figure between the cleaning of contact surface 551 and the cleaning of non-contact surface 552.

In embodiments using blade sensor 530 (FIG. 5A), controller 512 is further responsive to blade sensor 530 for causing blade 250 to retract when an image artifact is detected and blade 250 is in mechanical contact with non-deposition area 515. That is, the blade retracts only when it's doing so will not substantially affect the quality of the image in the deposition area. This advantageously reduces the chance of image degradation due to, e.g., clumps of toner dropping off blade 250 into deposition area 510.

In various embodiments, controller 512 is further adapted to re-engage blade 250 with rotatable member 501 in non-deposition area 515. In one example, when rotatable member 501 is divided into frames, in each of which a single print image is formed, blade 250 is retracted in an inter-frame non-deposition area. Blade 250 is then re-engaged with rotatable member 501 later in the same inter-frame area. In another example, blade 250 is re-engaged in the next, or another successive, inter-frame area, thus skipping one or more frames so that toner is not removed from those frames by blade 250. This provides more time to clean blade 250. In an embodiment, same-frame re-engagement with rapid cleaning of blade 250 is used normally, but skip-frame re-engagement together with a more thorough cleaning of blade 250 is used after a selected number of frames or of blade retraction cycles.

Figure 6:
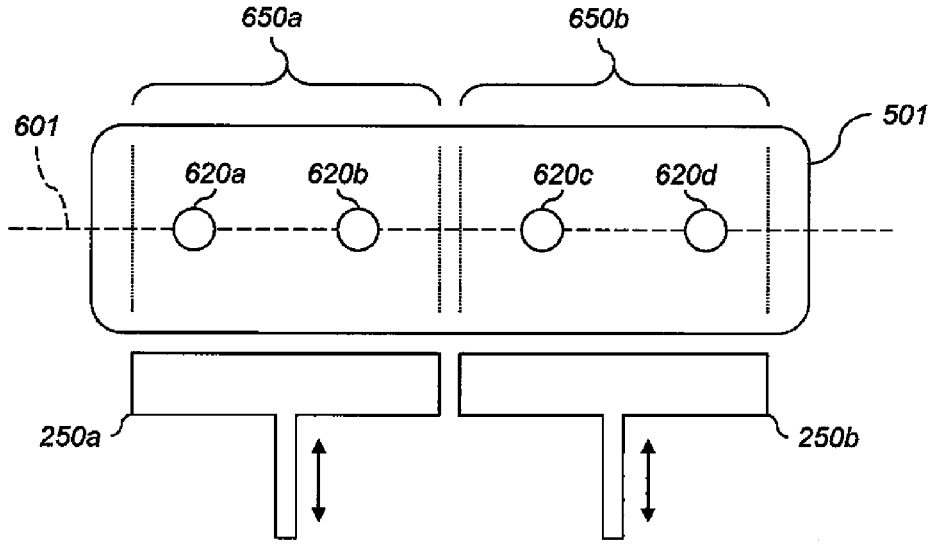
FIG. 6 shows a front elevational cross-section of apparatus for cleaning a rotatable member in an electrophotographic (EP) printer according to various embodiments.

FIG. 6 shows a front elevational cross-section of apparatus for cleaning a rotatable member in a dry electrophotographic (EP) printer according to various embodiments. Rotatable member 501 has longitudinal axis 601. For drums, longitudinal axis 601 is the axis about which the drum rotates, or through the endpoints of which the drum is mounted. For webs, longitudinal axis 601 is an axis perpendicular to the direction of travel of the web. However, for webs, the components can be set at a significant angle to the perpendicular of the web travel direction, e.g., at 15°, 30°, 45°, or another angle away from the perpendicular. These uses are also encompassed in the term "longitudinal axis."

First selectively-retractable blade 250*a* and second selectively-retractable blade 250*b* are arranged along the longitudinal axis 601 of rotatable member 501, so that each blade defines a respective span 650*a*, 650*b* of longitudinal axis 601 of rotatable member 501 from which it removes toner. Dotted lines are for clarity and do not depict structure. Spans 650*a*, 650*b* can be adjacent, butted up against each other directly, or overlapping. In this way, toner can be selectively removed from certain areas of a wide rotatable member 501 or can be removed from the whole member with lower-mass, less-expensive blades. Shorter blades also require less care to maintain dimensional accuracy over their lengths than longer blades.

Artifact sensor 520 (FIG. 5B) includes a plurality of sensing elements 620*a*, 620*b*, 620*c*, 620*d* arranged along the longitudinal axis 601 of rotatable member 501 to detect toner image artifacts at different points along longitudinal axis 601 of rotatable member 501.

Controller 512 (FIG. 5B) is further adapted to cause first blade 250*a* to retract when an artifact is detected in span 650*a* of first blade 250*a* and first blade 250*a* is in mechanical contact with non-deposition area 515 (FIG. 5A), and to cause second blade 250*b* to retract when an image artifact is detected in span 650*b* of second blade 250*b* and second blade 250*b* is in mechanical contact with non-deposition area 515.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
111 imaging member
112 transfer member
113 transfer backup member
201 transfer nip
202 second transfer nip
206 photoreceptor
210 charging subsystem
211 meter
212 meter
213 grid
216 surface
220 exposure subsystem
225 development subsystem
Parts List-Continued
226 toning shell
227 magnetic core
230 developer supply
234 developer
236 toning zone
240 power source
250 blade
250*a* first selectively retractable blade
250*b* second selectively retractable blade
251 power source
252 electromagnetic actuator
253 spring
356 blade-cleaning member
410 deposit toner on member step
415 receiver available data
420 decision step
430 engage blade step
440 rotate member step
450 disengage blade step
455 retract past cleaning member step
458 re-engage step
460 clean toner off blade step
470 transport cleaned toner step
501 rotatable member
510*a*, 510*b* toner deposition area

512 controller
513 transfer zone
515 non-deposition area
520 artifact sensor
525 inspection area
530 blade sensor
Parts List-Continued
535 inspection area
540 toner supply
542 receiving member
551 contact surface
552 non-contact surface
556 actuator
601 longitudinal axis
620*a*, 620*b*, 620*c*, 620*d* sensing element
650*a*, 650*b* span
716 surface
738, 739 toner particle
787 contaminant
S slow-scan direction

The invention claimed is:

1. An apparatus for cleaning a rotatable member in an electrophotographic (EP) printer, comprising:

a. the rotatable member having a deposition area and a non-deposition area; a toner supply operatively connected to the rotatable member to supply toner to the rotatable member, and a moving receiving member arranged with respect to the rotatable member so that toner is transferred from the deposition area of the rotatable member to the receiving member while the rotatable member rotates;

b. a selectively-retractable blade in mechanical contact with the rotatable member so that toner is removed from the deposition area while the rotatable member rotates;

c. an artifact sensor for automatically detecting a toner image artifact on the receiver;

d. a controller responsive to the artifact sensor for causing the blade to retract when an artifact is detected; and e. a blade cleaner for cleaning the blade while the blade is not in mechanical contact with the rotatable member.

2. The apparatus according to claim 1, further comprising a blade sensor for detecting when the blade is in mechanical contact with the non-deposition area;

wherein the controller is further responsive to the blade sensor for causing the blade to retract when an image artifact is detected and the blade is in mechanical contact with the non-deposition area.

3. The apparatus according to claim 2, wherein the controller is further adapted to re-engage the blade with the rotatable member in the non-deposition area.

4. The apparatus according to claim 1, further comprising a second selectively blade, the first and second blades arranged along the longitudinal axis of the rotatable member, so that each blade defines a respective span of the longitudinal axis of the rotatable member from which it removes toner;

wherein the artifact sensor includes a plurality of sensing elements arranged along the longitudinal axis of the rotatable member to detect toner image artifacts at different points along the longitudinal axis of the rotatable member; and the controller is further adapted to cause the first blade to retract when an artifact is detected in the span of the first blade and the first blade is in mechanical contact with the non-deposition area, and to cause the second blade to retract when an image artifact is detected in the span of the second blade and the second blade is in mechanical contact with the non-deposition area.

5. The apparatus according to claim 1, wherein the blade cleaner includes a stationary blade-cleaning member arranged with respect to the blade to clean the blade while the blade retracts.

6. The apparatus according to claim 1, wherein the blade cleaner includes a movable blade-cleaning member and an actuator responsive to the controller to push the movable blade-cleaning member across the retracted blade.

7. The apparatus according to claim 1, wherein the rotatable member further includes a transfer zone arranged after the deposition area in the direction of rotation of the member and the blade is arranged with respect to the rotatable member after the deposition area and prior to the transfer zone in the direction of rotation of the member.

* * * * *